US008539709B2

(12) United States Patent
Otto

(10) Patent No.: US 8,539,709 B2
(45) Date of Patent: Sep. 24, 2013

(54) GUN, BOW, CROSSBOW, CAMERA AND BINOCULAR HOLDING DEVICE

(75) Inventor: Timothy L. Otto, Kansas City, MO (US)

(73) Assignee: Ottr Enterprises, LLC, Kansas City, MO (US)

( * ) Notice: Subject to any disclaimer, the term of this patent is extended or adjusted under 35 U.S.C. 154(b) by 1813 days.

(21) Appl. No.: 11/625,905

(22) Filed: Jan. 23, 2007

(65) Prior Publication Data

US 2010/0251592 A1 Oct. 7, 2010

(51) Int. Cl.
*F41C 27/00* (2006.01)

(52) U.S. Cl.
USPC ..... 42/94; 73/167

(58) Field of Classification Search
USPC ..... 42/94; 73/167
See application file for complete search history.

(56) References Cited

U.S. PATENT DOCUMENTS

| | | | | |
|---|---|---|---|---|
| 3,200,528 | A * | 8/1965 | Christensen | 42/94 |
| 4,575,964 | A | 3/1986 | Griffin | |
| 4,579,265 | A | 4/1986 | Schiller | |
| 4,676,021 | A * | 6/1987 | Groba | 42/94 |
| 5,784,820 | A | 7/1998 | Wood | |
| 5,819,463 | A * | 10/1998 | Amos | 42/94 |
| 5,903,995 | A * | 5/1999 | Brubach | 42/94 |
| 5,930,931 | A * | 8/1999 | Watson | 42/94 |
| 6,266,910 | B1 * | 7/2001 | Horine | 42/94 |
| 6,267,278 | B1 * | 7/2001 | Bogart | 224/222 |
| 6,267,335 | B1 * | 7/2001 | Barrett | 248/118 |
| 6,375,052 | B2 | 4/2002 | Keton | |
| 6,695,704 | B2 | 2/2004 | Parsons | |
| 6,889,465 | B1 | 5/2005 | Holmes | |
| 2005/0092790 | A1 * | 5/2005 | Guarniere et al. | 224/149 |
| 2005/0207749 | A1 * | 9/2005 | Barker et al. | 396/428 |
| 2005/0262753 | A1 * | 12/2005 | Lahti | 42/94 |
| 2007/0261287 | A1 * | 11/2007 | Hunt et al. | 42/94 |
| 2007/0266609 | A1 * | 11/2007 | Wuertz | 42/94 |

* cited by examiner

*Primary Examiner* — Samir Abdosh
(74) *Attorney, Agent, or Firm* — McKee, Voorhees & Sease, P.L.C.

(57) ABSTRACT

A gun rest for releasably attaching to the lower leg of a hunter. The rest is comprised of a lower leg support having upper and lower ends and formed to fit along the side of a leg. The leg support defines an inner leg contact surface and an outer surface. Attached to the outer surface is a telescoping member adjustable for height with an upper end that is attached to a gun support rest or bracket. The lower leg support is releasably attached to the lower leg of a hunter between the knee and the ankle, preferably by releasable straps. It may therefore be carried as the hunter moves about the fields, and when the hunter sits, for example on a deer stand, the rest may be telescoped up for use to create a steady aim.

11 Claims, 4 Drawing Sheets

GUN, BOW, CROSSBOW, CAMERA AND BINOCULAR HOLDING DEVICE

FIELD OF THE INVENTION

This invention relates to a gun rest for use by hunters, particularly as they are on stand, for example, in deer hunting.

BACKGROUND OF THE INVENTION

Individuals who engage in the sport of hunting are constantly looking for new products that will provide advantages in the field. Those products may provide advantages of comfort, convenience, or improvements which allow increased shooting accuracy. The present invention relates to a device which allows all three advantages combined into one.

In many types of hunting, establishing stand positions from which shooting accuracy may be achieved is essential. This occurs in, for example, white tail deer hunting when one uses tree stands or field stands along the travel paths of the pursued deer. It also occurs for other big game. And, it occurs for other pursued game, such as coyotes, and turkeys during spring turkey season.

In all of these hunting experiences, the one common thread that runs through them is the hunter is on a stand while animals hopefully travel by, unwary that a hunter stands in stealth and in pursuit of an accurate shot at the hunted animal.

In most all of these endeavors, it is essential that the hunter move quickly and quietly when the pursued game comes within range. Success depends on steady aim and an accurate shot all with a minimum of movement so that they are undetected by the animal pursued.

While gun rests have been developed in the past, and are used regularly with some success, most have the problem that they are an extra item to carry. This results in a risk that they will be mislaid, or placed inconveniently away from the hunter, or at times even forgotten and left behind. The resulting movement to find and ready the gun nest when game is approaching creates a greater risk of detection. As a result, and in order to avoid that greater risk of detection, many hunters choose not to make the extra movement purpose of the gun rest in the first instance is lost; and in the second instance creates a risk of detection as the animal approaches.

This invention has as its primary objective the development of a steadying gun rest, which is portable, and which may be conveniently taken into the field, attached to the hunter's lower leg, all without sacrifice of hunter mobility or comfort. When the hunter is ready for use, and in a sitting position, the telescoping gun rest may be raised with a minimum of movement and the gun steadied for an accurate shot.

While gun rests have been achieved in the past, no one has developed one which may be detachably secured to the lower leg for easy portability to the hunting site and for assured ready availability with a minimum of movement when the all important time for a shot arrives.

BRIEF SUMMARY OF THE INVENTION

A gun rest for releasably attaching to the lower leg of a hunter. The rest is comprised of a lower leg support having upper and lower ends and formed to fit along the side of a leg. The leg support defines an inner leg contact surface and an outer surface. Attached to the outer surface is a telescoping member adjustable for height with an upper end that is attached to a gun support rest or bracket. The lower leg support is releasably attached to the lower leg of a hunter between the knee and the ankle, preferably by releasable straps. It may therefore be carried as the hunter moves about the fields, and when the hunter sits, for example on a deer stand, the rest may be telescoped up for use to create a steady aim.

DETAILED DESCRIPTION OF THE PREFERRED EMBODIMENT

Figure 1:
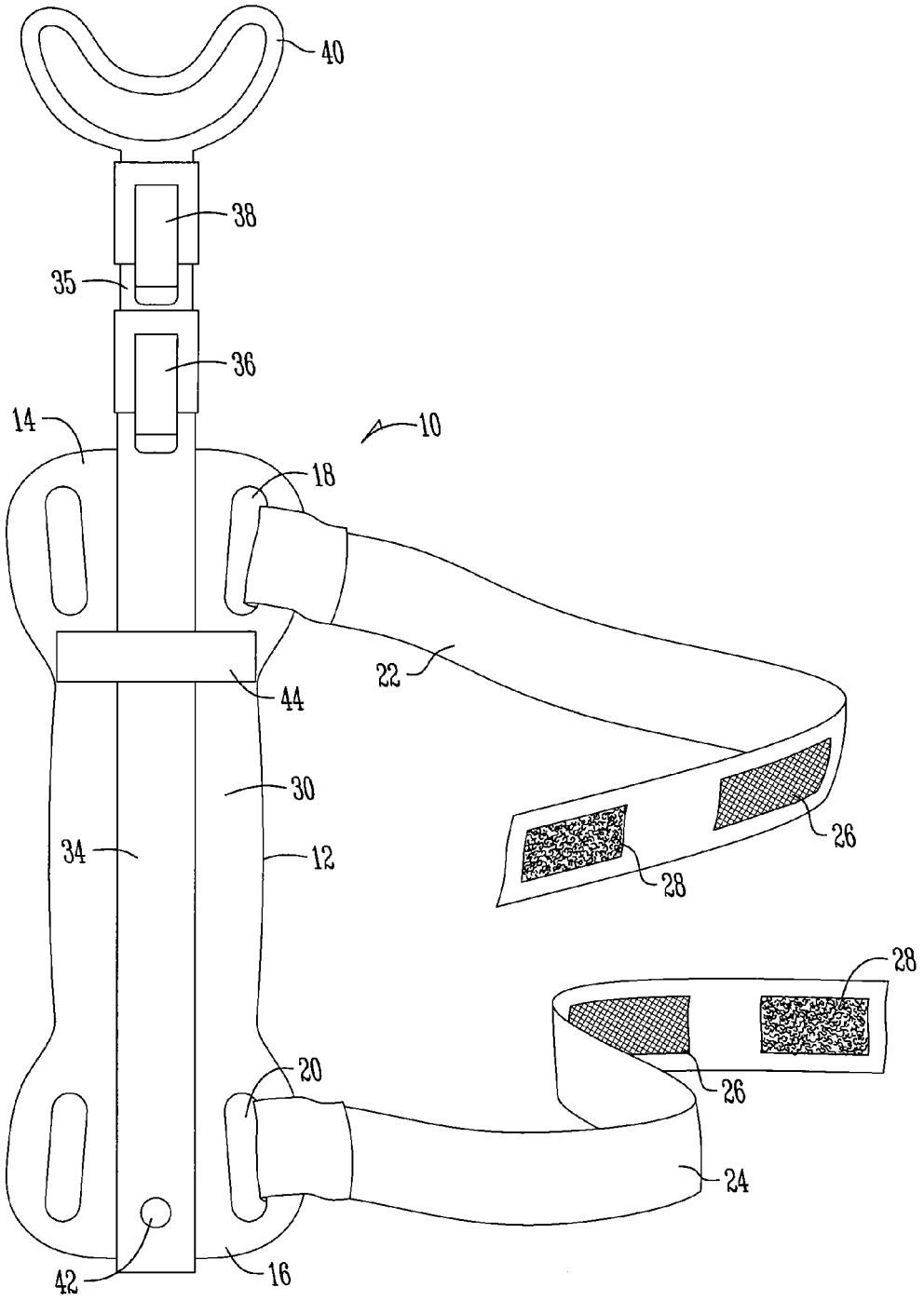
FIG. 1 is a plan view of a portable gun rest of the present invention.
Figure 2:
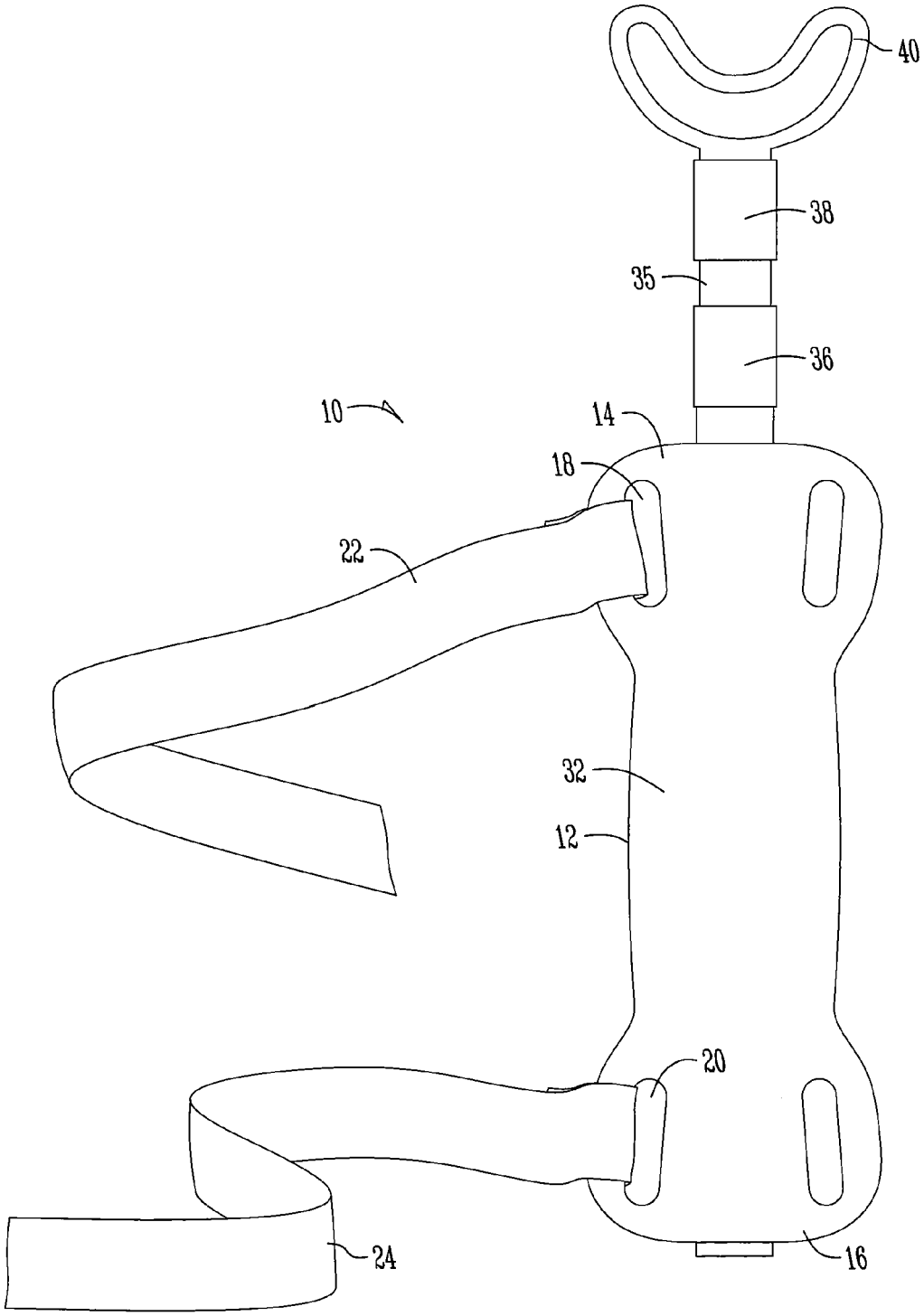
FIG. 2 is a bottom view of the gun rest shown in FIG. 1.
Figure 3:
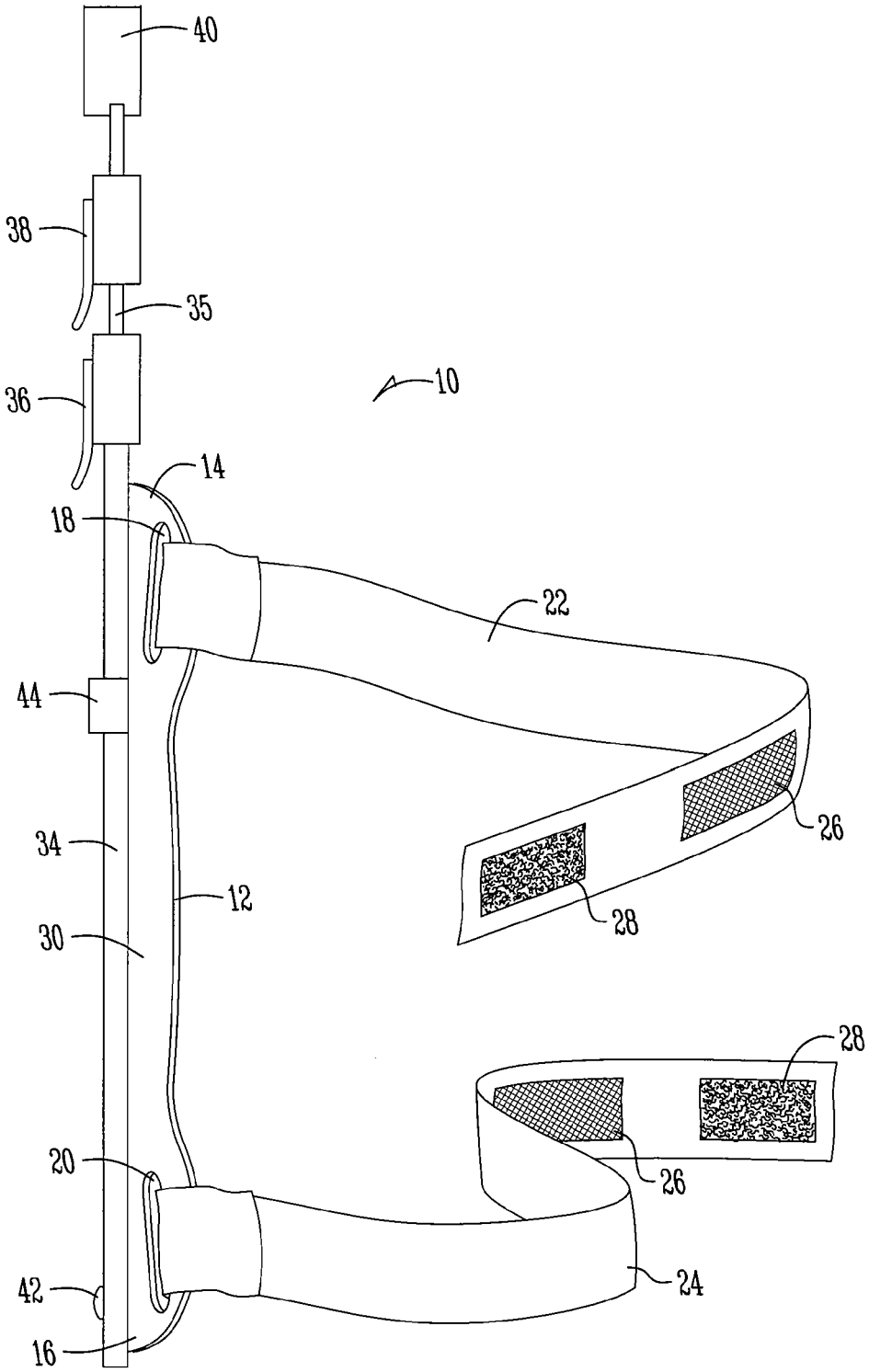
FIG. 3 is a side view along line 3-3 of the gun rest of FIG. 1.

FIG. 1 shows a preferred embodiment 10 of the gun rest of the present invention. The gun rest 10 generally comprises a lower leg support 12 having upper end 14 and lower end 16 which is form fit to the lower leg 17 of a hunter. Leg support 12 has an upper strap slot 18 and a lower strap slot 20 through which calf straps 22 and 24, respectively, are threaded. The leg support 12 may be made of a variety of different materials, including metals, wood, polymeric plastic material or the like. Straps 22 and 24 may be nylon or canvass or other suitable strap material. Preferably, they are affixed by adjustable nylon loops or as depicted in FIGS. 2 and 3, particularly Velcro® fasteners using hook and pile attaching systems 26, 28.

Leg support 12 has a convex or arcuate outer surface 30 and a similar inner surface 32 which is smooth and form fits to the lower leg 17. Attached to the outer surface 30 parallel to its longitudinal axis is telescoping member 34 having locks 36, 38. Attached to the innermost telescoping member 35 is a gun rest 40 which may be rigidly secured or pivotally secured, at the option of the manufacturer. If it is rigidly secured, it is preferred that telescoping members 34 be rectangular in cross-section. If it is pivotally secured, it is preferred that telescoping member 34 be circular in cross-section as opposed to rectangular. For some uses, rigid gun rest 40 is preferred and for others pivotally secured gun rest 40 is preferred. Outer telescope 34 is secured to leg support 12 at 42 and may pivot from side to side. Slide 44 can be adjustably moved up and down to control the side to side movement of telescope tube 34.

Figure 4:
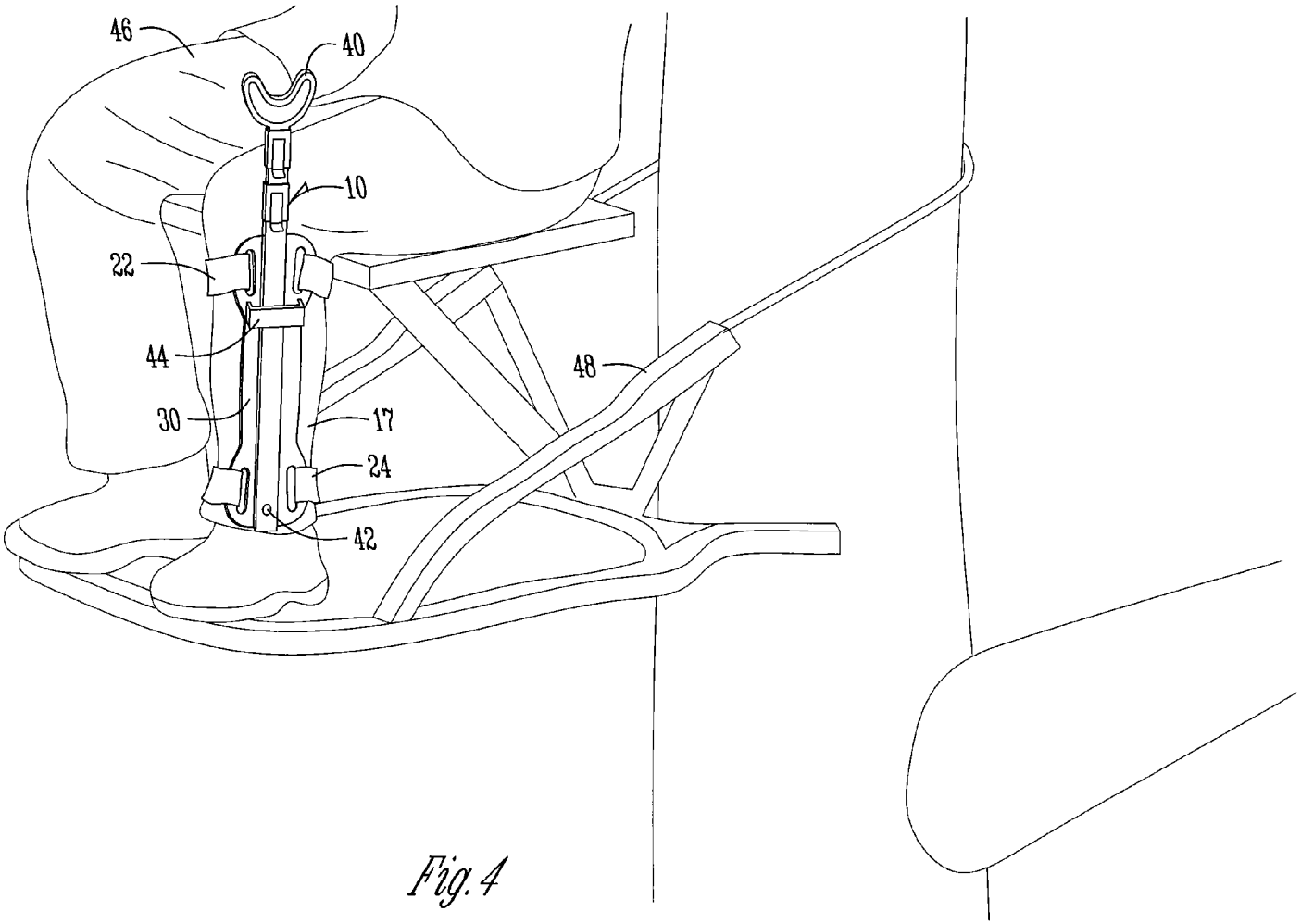
FIG. 4 is an in-use position drawing showing the rest strapped to the leg of a sitting hunter.

In actual operation the device works as illustrated in FIG. 4. A gun hunter may be on a stand 48 or seated on a stump, as illustrated in FIG. 4. Nylon straps 22 and 24 are wrapped around the leg as illustrated in FIG. 4 and secured by Velcro® type fasteners having hook and pile configurations 26, 28. Upon seeing an animal in range for shooting, the telescoping gun rest 10 is raised by unlocking locks 36, 38 freeing it to move to the desired position as illustrated in FIG. 4, then again locking them and the gun is rested in the rest 40 for steady aim. After the shot is achieved, the telescope may be returned to its down position by unlocking locks 36, 38 pushing it in, and the hunter may get up and move to another position, confident that the gun rest is always with him, always available, and easy to access for use with a minimum of movement to another position, confident that the gun rest is always with him, always available, and easy to access for use with a minimum of movement.

Certain constructional features are worthy of mention. While FIG. 4 shows the user sitting, this device works equally as well for kneeling and standing hunters, especially using the preferred height adjustment which ranges 15½ inches up to 60 inches.

While the description here given, has been in the context of a gun rest, it should be understood that this is exemplary only and but a preferred embodiment. For example, gun rest or yolk 40, can be modified to a rest or holder for a bow, crossbow, camera and/or binoculars. In this way the versatility of the device is enhanced while still employing the inventive concept.

It therefore can be seen that the invention accomplishes at least all of its stated objectives.

What is claimed is:

1. A gun rest for releasable attachment to the lower leg below the knee, comprising:

an elongated lower leg support having upper and lower ends, an inner leg contact surface and an outer surface, formed to fit the lower leg;

a telescoping member adjustable for height attached to the outer surface of said lower leg support;

said telescoping member having an upper end with a gun support bracket attached to it; and means for releasably securing said lower leg support to a person's lower leg.

2. The gun rest of claim 1 wherein the gun support bracket is pivotally attached to the upper end of said telescoping member.

3. The gun rest of claim 1 wherein the gun support bracket is fixedly attached to the upper end of said telescoping member.

4. The gun rest of claim 1 wherein the means for releasably securing said lower leg support to a person's lower leg is releasable straps.

5. The gun rest of claim 4 wherein said straps releasably attach with adjustable loops.

6. The gun rest of claim 4 wherein said straps releasably attach with hook and pile fasteners.

7. The gun rest of claim 1 wherein lower leg support is formed of polymeric plastic material.

8. The gun rest of claim 1 wherein the telescoping member may be round, oval or rectangular in 3 to 5 sections.

9. A gun rest for releasable attachment to the lower leg below the knee, comprising:

an elongated lower leg support having upper and lower ends, an inner leg contact surface and an outer surface, formed to fit the lower leg;

a telescoping member adjustable for height attached to the outer surface of said lower leg support;

said telescoping member having an upper end with a gun support bracket attached to it; and releasable straps attached to said lower leg support for securing said leg support to a person's lower leg.

10. A method of providing a portable gun rest that is selectively attachable to the lower leg, comprising:

providing an elongated lower leg support that is formed to fit the lower leg and that is detachably attachable to the leg of a person, below the knee;

attaching a telescoping gun rest to the leg support for selective height adjustment of a gun rest.

11. A rest device for steadying another device, comprising:

a rest device for releasable attachment to the lower leg having an elongated lower leg support having upper and lower ends, an inner leg contact surface and an outer surface, formed to fit the lower leg;

a telescoping member adjustable for height attached to the outer surface of said lower leg support;

said telescoping member having an upper end with a support rest attached to it; and means for releasable securing of said lower leg support to a person's lower leg.

* * * * *